US008494694B2

(12) United States Patent
Dueck

(10) Patent No.: US 8,494,694 B2
(45) Date of Patent: Jul. 23, 2013

(54) MASS TRANSPORTATION SYSTEM

(76) Inventor: Raymond Dueck, East St. Paul (CA)

( * ) Notice: Subject to any disclaimer, the term of this patent is extended or adjusted under 35 U.S.C. 154(b) by 1006 days.

(21) Appl. No.: 12/508,678

(22) Filed: Jul. 24, 2009

(65) Prior Publication Data

US 2011/0022252 A1 Jan. 27, 2011

(51) Int. Cl.
*B61B 7/06* (2006.01)

(52) U.S. Cl.
USPC ..... 701/19; 104/27; 104/28; 104/89; 104/91; 104/112; 105/149.1

(58) Field of Classification Search
USPC ..... 701/19; 104/27, 28, 89, 90, 91, 112; 105/149.1; 246/1
See application file for complete search history.

(56) References Cited

U.S. PATENT DOCUMENTS 3,631,806 A * 1/1972 Barthalon ..... 104/89
3,858,518 A * 1/1975 Nyman ..... 104/124
3,926,126 A * 12/1975 Voss ..... 104/130.04
3,987,734 A * 10/1976 Horn ..... 104/88.03
4,059,194 A * 11/1977 Barry ..... 414/278
4,069,765 A * 1/1978 Muller ..... 104/123
4,152,992 A * 5/1979 Mackintosh ..... 104/130.04
4,208,969 A * 6/1980 Baltensperger et al. ..... 104/111
4,641,587 A * 2/1987 Dalliard ..... 105/3
4,944,227 A * 7/1990 Madsen ..... 104/103
5,219,395 A * 6/1993 Spieldiener et al. ..... 104/130.11
5,237,931 A * 8/1993 Riedl ..... 104/28
5,372,072 A * 12/1994 Hamy ..... 104/93
5,473,233 A * 12/1995 Stull et al. ..... 318/587
5,592,883 A * 1/1997 Andress, III ..... 104/88.03
5,775,227 A * 7/1998 Mullen ..... 104/88.04
5,797,330 A * 8/1998 Li ..... 104/28
5,836,423 A * 11/1998 Kunczynski ..... 187/245
6,109,568 A * 8/2000 Gilbert et al. ..... 246/3
6,290,188 B1 * 9/2001 Bassett ..... 246/182 R
6,606,954 B1 * 8/2003 Lamoreaux et al. ..... 104/123
6,810,817 B1 * 11/2004 James ..... 104/88.04
6,877,439 B2 * 4/2005 Chapman ..... 104/118
7,246,559 B2 * 7/2007 Stromberg ..... 104/124
7,302,319 B2 * 11/2007 Wu ..... 701/19
7,513,463 B2 * 4/2009 Rossmann et al. ..... 246/1 C
7,681,505 B2 * 3/2010 Lowson et al. ..... 104/28
2004/0225421 A1 * 11/2004 Wu ..... 701/19
2010/0319565 A1 * 12/2010 Mobasher ..... 104/89

* cited by examiner

*Primary Examiner* — Thomas Black
*Assistant Examiner* — Peter D Nolan
(74) *Attorney, Agent, or Firm* — Neustel Law Offices

(57) ABSTRACT

A mass transportation system for efficiently transporting a plurality of passengers along a predetermined path from a loading station to an unloading station. The transportation system generally includes a support structure, a track positioned above ground level via the support structure, and a carrier vehicle operable along the track. A first control module operable by a passenger is located outside the carrier vehicle upon a loading station for signaling the carrier vehicle to stop along the track at the loading station and a second control module operable by the passenger is located inside the carrier vehicle for signaling the carrier vehicle to stop along the track at an unloading station.

17 Claims, 7 Drawing Sheets

MASS TRANSPORTATION SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a transportation utility and more specifically it relates to a mass transportation system for efficiently transporting a plurality of passengers along a predetermined path from a loading station to an unloading station.

2. Description of the Related Art

Any discussion of the related art throughout the specification should in no way be considered as an admission that such related art is widely known or forms part of common general knowledge in the field.

Transportation systems, such as automobiles, trains, subways, buses, and airplanes are all used by a wide majority of the public to travel to various destinations. Today, more than ever, mass transportation is becoming more and more congested especially in cities. Highways to provide for automobiles and buses are often times overcrowded causing individuals to wait for prolonged periods in traffic. In addition, the congestion of current transportation often times leads to more accidents because individuals are trying to rush, or maneuver around traffic.

Other types of public transportation, such as monorails, trains, and airplanes, are generally very expensive to operate and require a large crew providing upkeep and to operate the transportation vehicles. Because of the inherent problems with the related art, there is a need for a new and improved transportation system for efficiently transporting a plurality of passengers along a predetermined path from a loading station to an unloading station.

BRIEF SUMMARY OF THE INVENTION

A system for efficiently transporting a plurality of passengers along a predetermined path from a loading station to an unloading station. The invention generally relates to a transportation utility which includes a support structure, a track positioned above ground level via the support structure, and a carrier vehicle operable along the track. A first control module operable by a passenger is located outside the carrier vehicle upon a loading station for signaling the carrier vehicle to stop along the track at the loading station and a second control module operable by the passenger is located inside the carrier vehicle for signaling the carrier vehicle to stop along the track at an unloading station.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
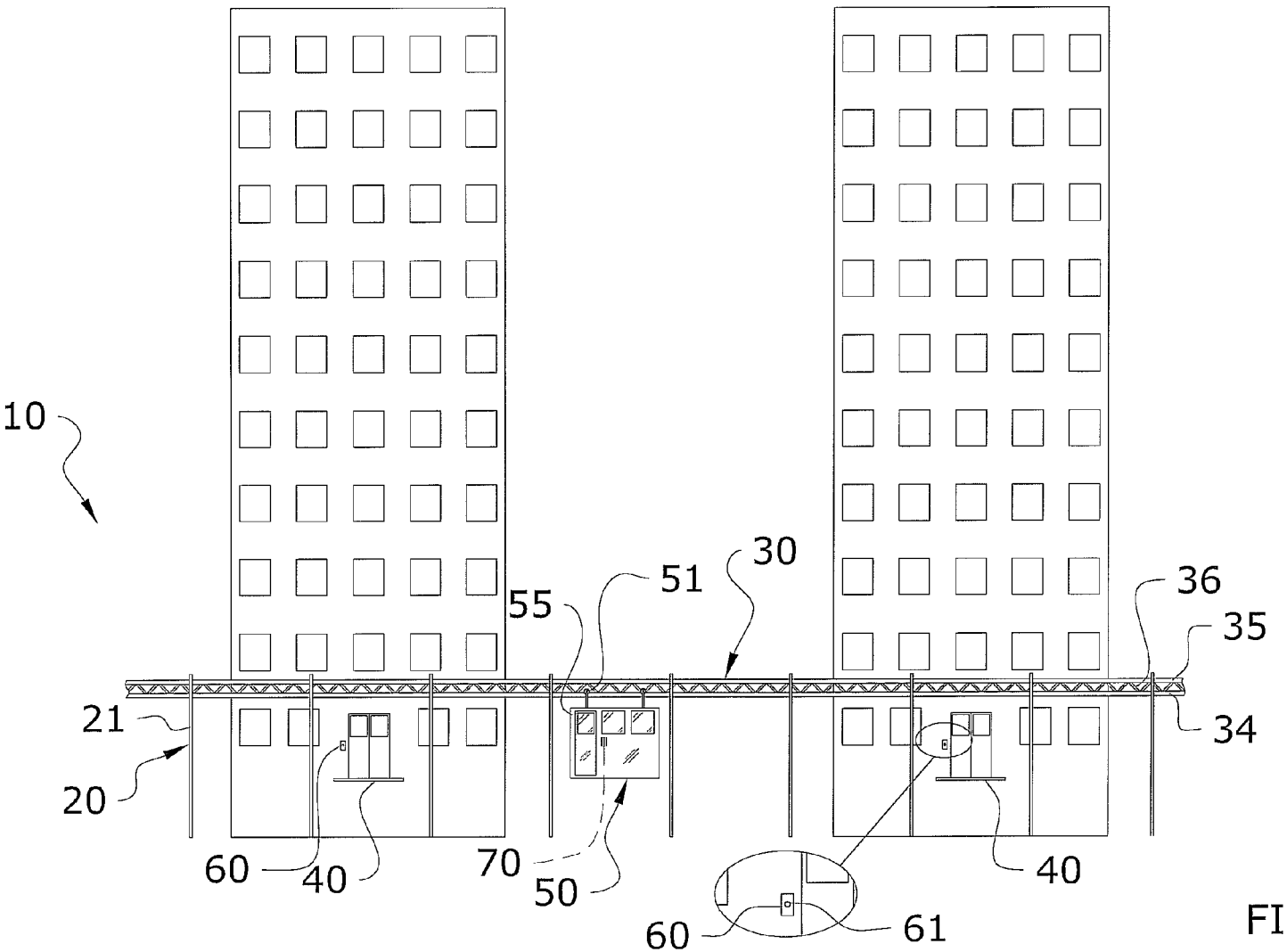
FIG. 1 is a side illustration of the carrier vehicle moving along the track in a city.
Figure 2:
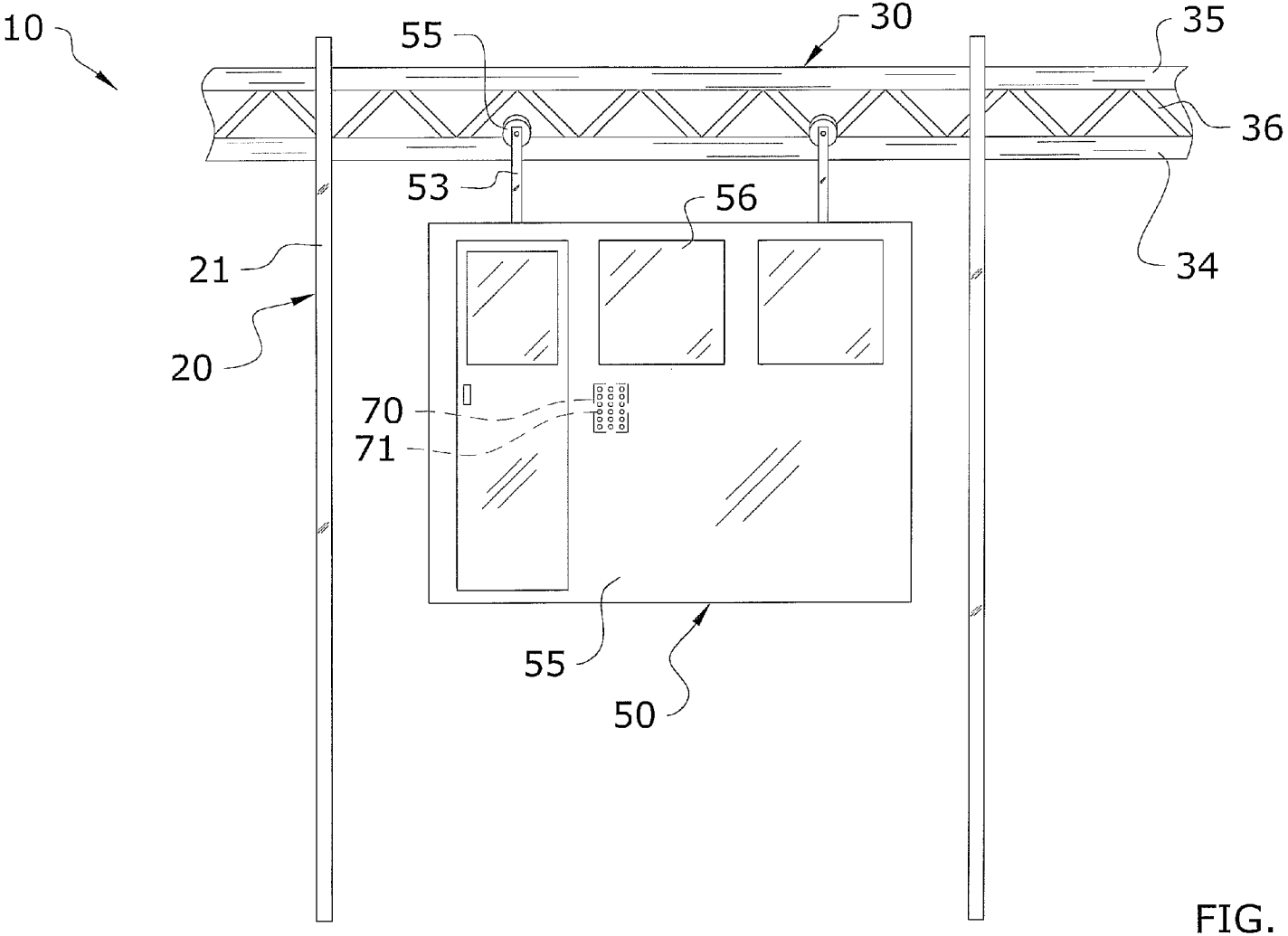
FIG. 2 is a side view of the carrier vehicle moving along the track.
Figure 3:
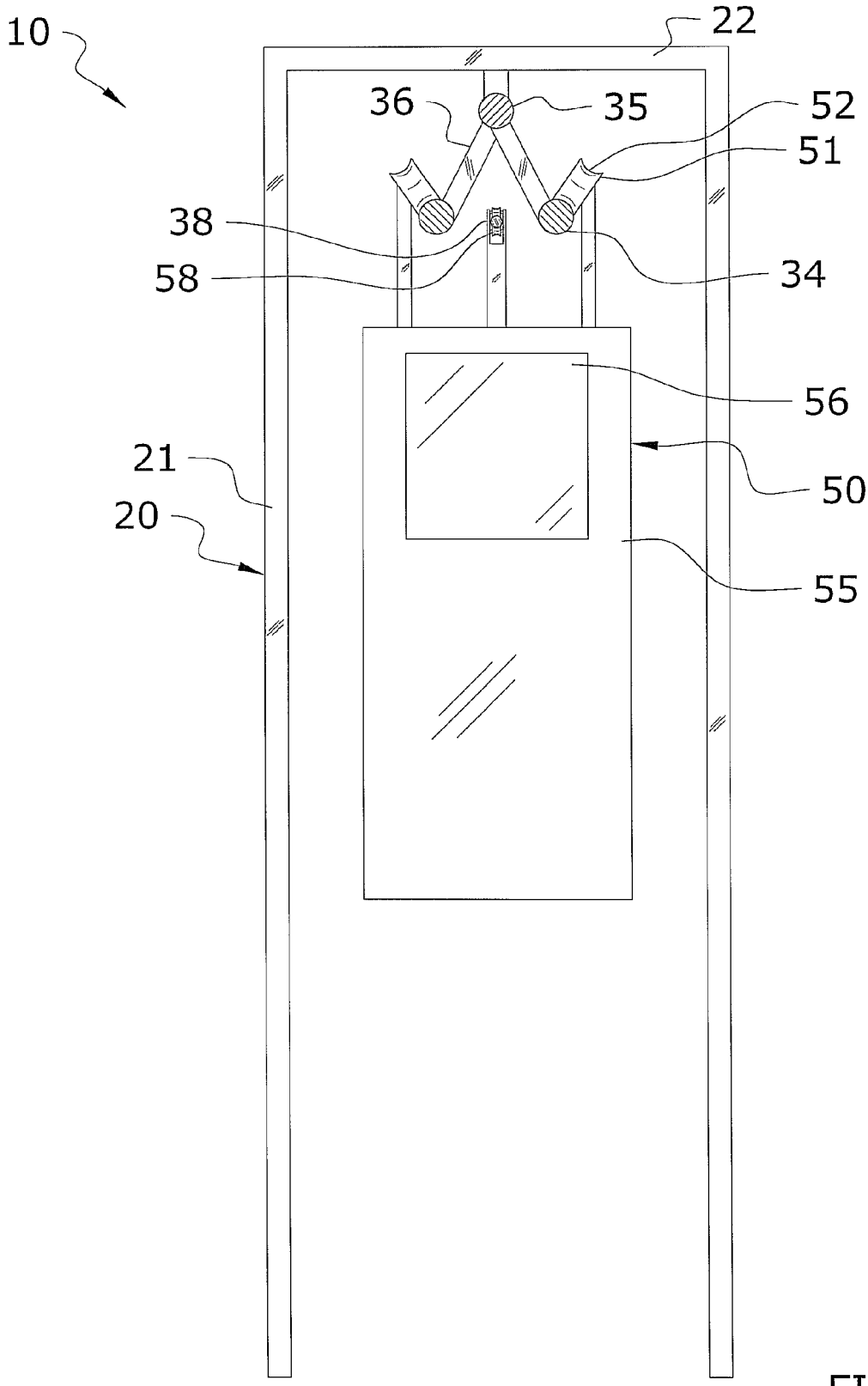
FIG. 3 is a front view of the carrier vehicle moving along the track.
Figure 4:
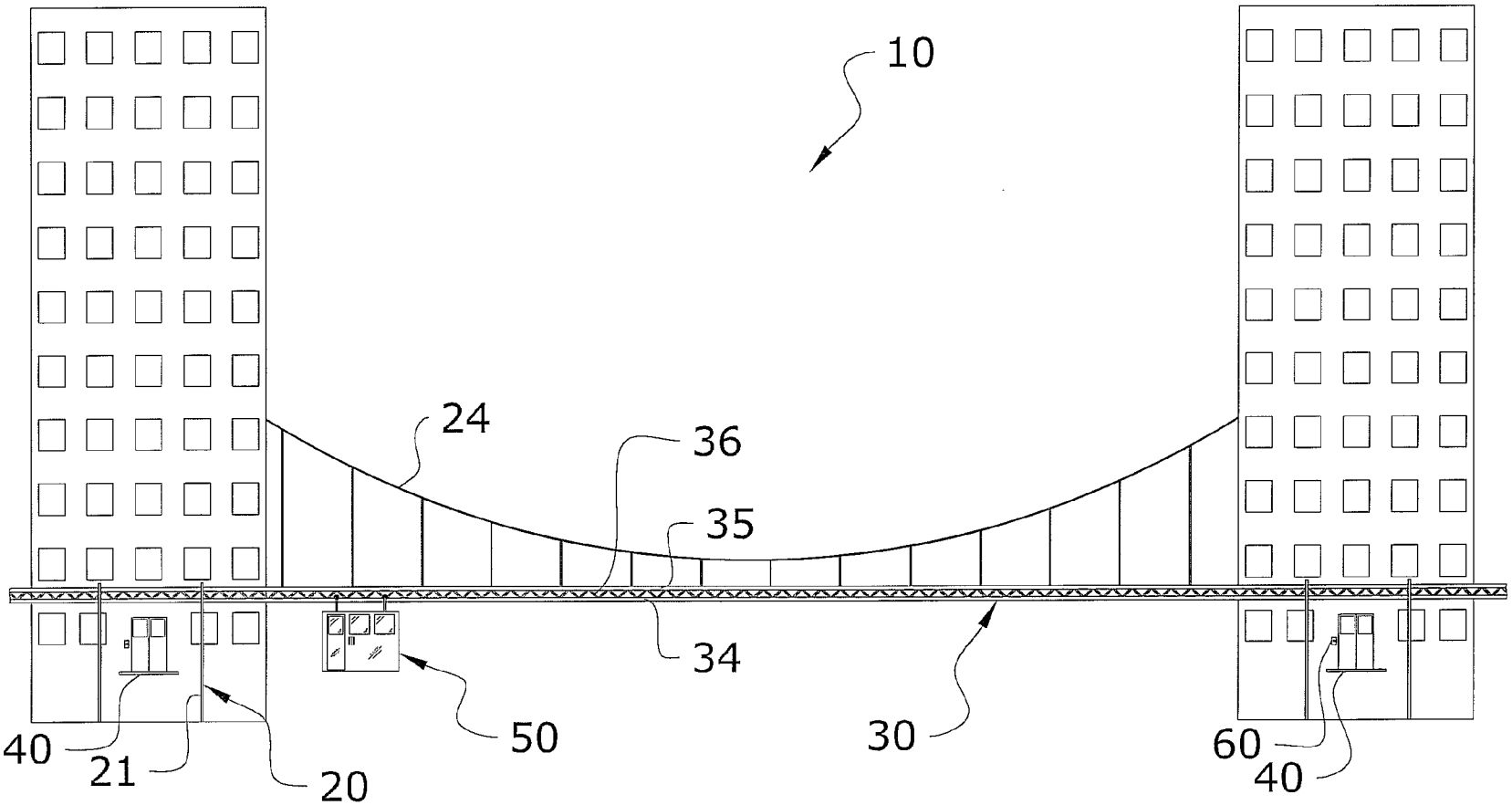
FIG. 4 is a side illustration of the carrier vehicle moving along the track in a city with an alternate embodiment of the track.
Figure 5:
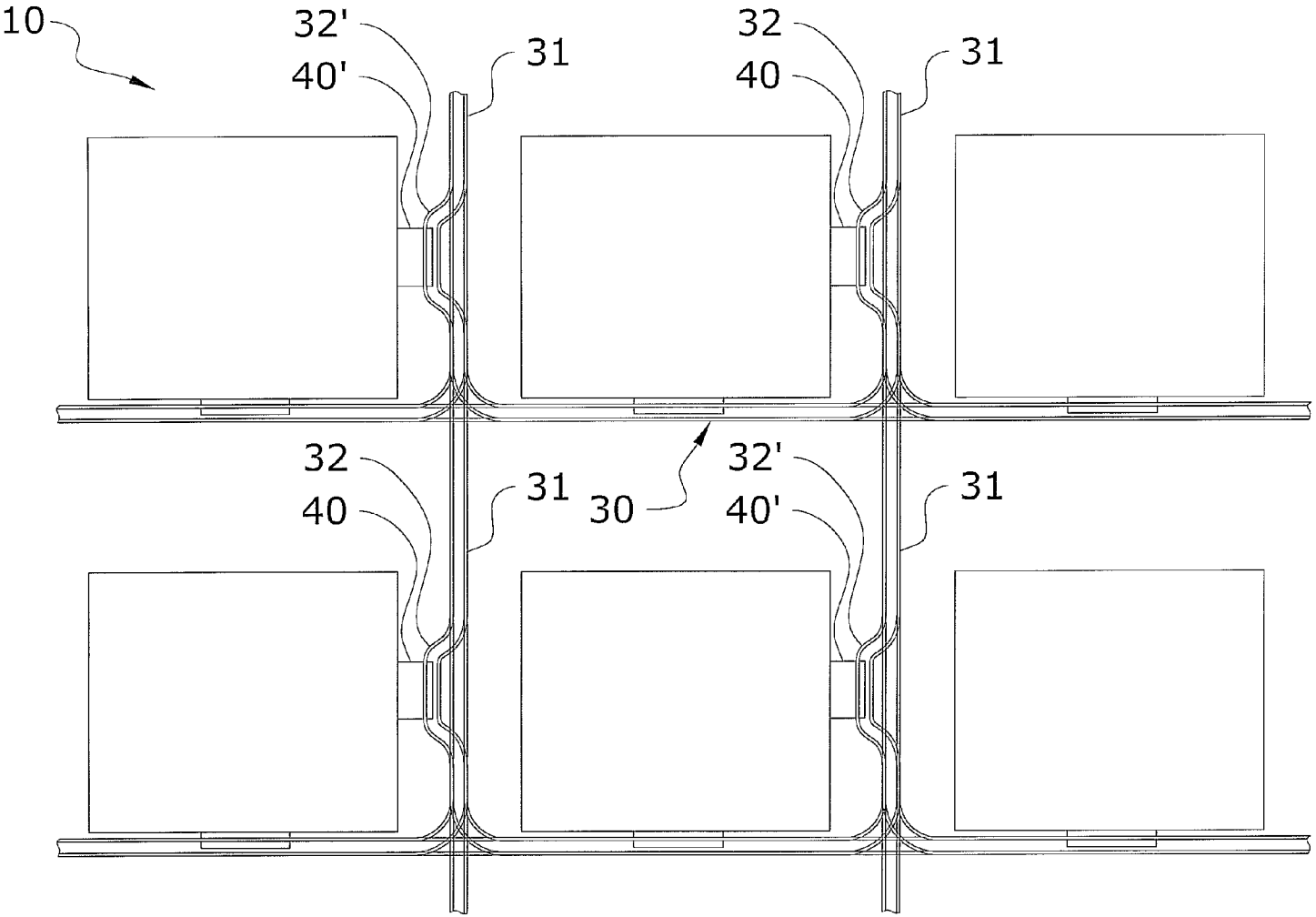
FIG. 5 is a plan view of the track showing a plurality of primary lanes and a plurality of bypass lanes all interconnected.
Figure 6:
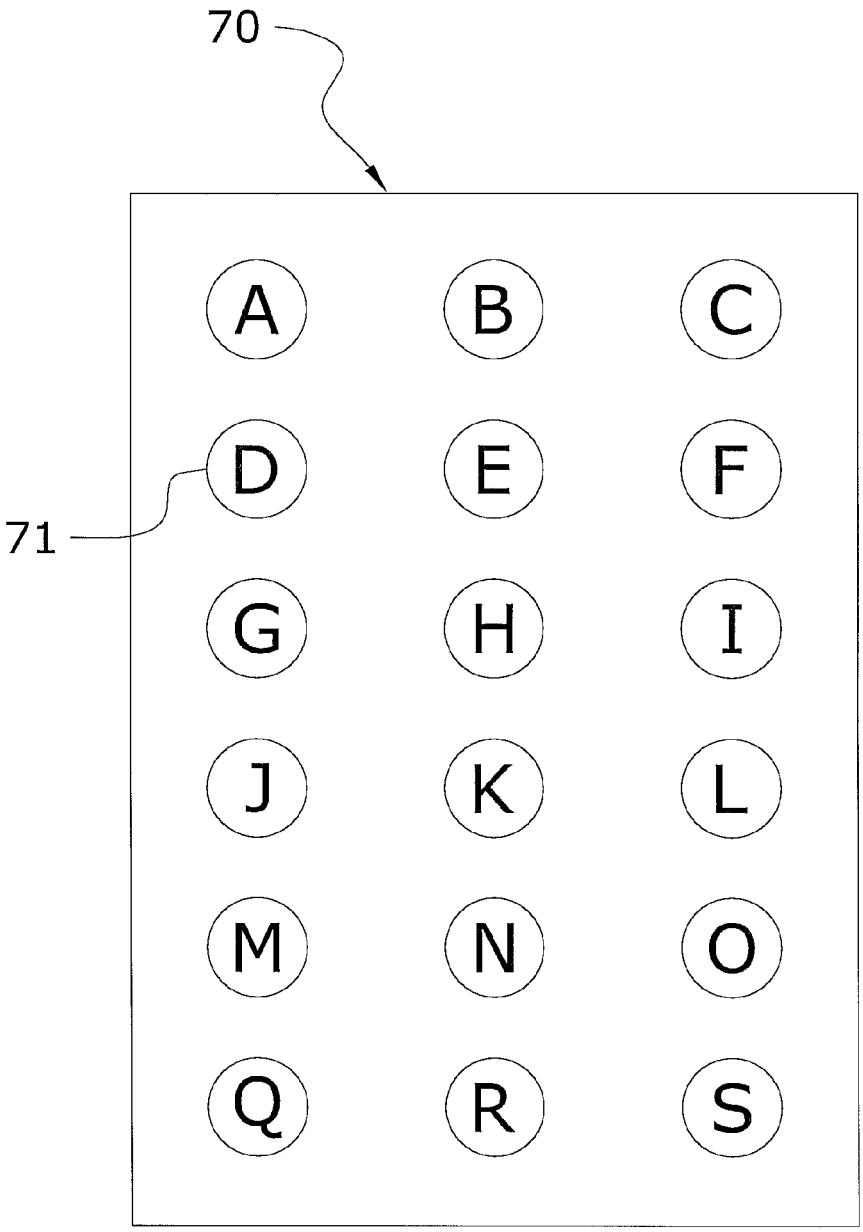
FIG. 6 is a front view of a possible setup of the second control module.
Figure 7:
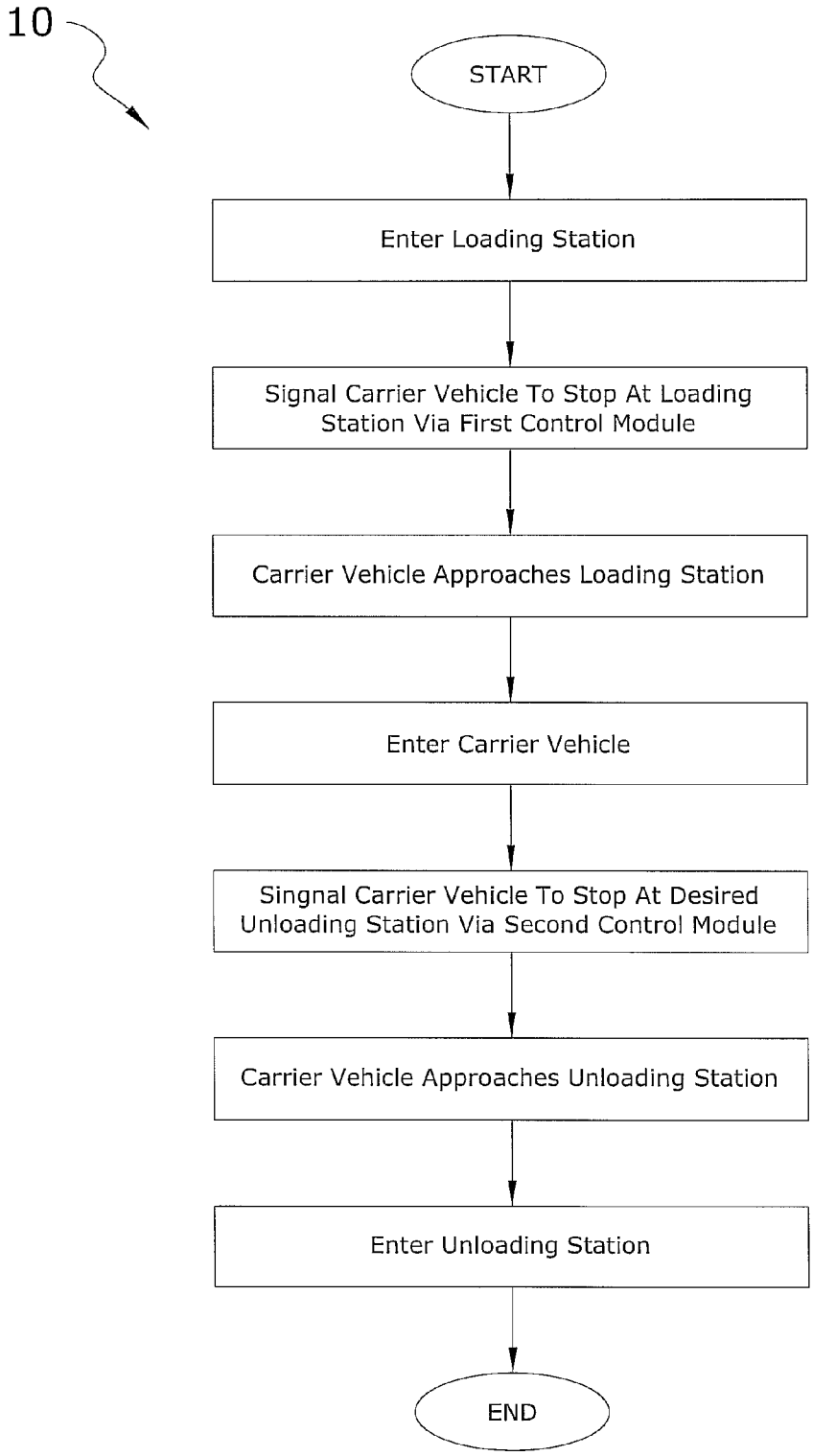
FIG. 7 is a flowchart describing the process of operating the control modules to use the carrier vehicles.

Turning now descriptively to the drawings, in which similar reference characters denote similar elements throughout the several views, FIGS. 1 through 7 illustrate a mass transportation system 10, which comprises a support structure 20, a horizontal track 30 connected to the support structure 20, wherein the track 30 is positioned above ground level, wherein the track 30 includes a primary lane 31, a first bypass lane 32, and a second bypass lane 32', wherein the first bypass lane 32 and the second bypass lane 32' are connected to the primary lane 31. A loading station 40 is accessible from the first bypass lane 32 and an unloading station 40' accessible from the second bypass lane 32'.

A first bypass lane 32 travels off the primary lane 31 prior to the loading station 40 and wherein the first bypass lane 32 merges with the primary lane 31 after the loading station 40 and a second bypass lane 32' travels off the primary lane 31 prior to the unloading station 40 and wherein the second bypass lane 32' merges with the primary lane 31 after the unloading station 40. A carrier vehicle 50 is connected to the horizontal track 30, wherein the carrier vehicle 50 is operable along the primary lane 31, the first bypass lane 32, and the second bypass lane 32' of the track 30.

A first control module 60 located outside the carrier vehicle 50 at the loading station 40 is for signaling the carrier vehicle 50 to stop along the first bypass lane 32 at the loading station 40 and a second control module 70 located inside the carrier vehicle 50 for signaling the carrier vehicle 50 to stop along the second bypass lane 32' at the unloading station 40'. The loading station 40 and unloading station 40' may be referred to herein as "loading/unloading station", wherein the loading station 40 and unloading station 40' may be separate or integral. A main feature of the present invention is the ability for the users to load upon the carrier vehicles 50 and select a destination without the carrier vehicles 50 needing a separate operator.

B. Support Structure

The support structure 20 is used to support the track 30 above a ground level, which includes the ground surface, water surface, city obstructions, or various other structures extending from the ground. The support structure 20 may also be used to support the track 30 through a tunnel, mountain, building, or various other types of structures that may be considered desired destinations or stand in the way of the track 30. The support structure 20, because of the many types of terrain that the support structure 20 can encounter, may take on a variety of shapes and configurations, as well as be comprised of various types of materials.

In one embodiment, the support structure 20 includes a pair of vertical columns 21 spaced apart to allow a carrier vehicle 50 to travel between. A horizontal structure 22 or beam connected at upper end of the two columns 21, forming an inverted U-shaped configuration. The track 30 will then be attached to the horizontal structure 22 and the carrier vehicle 50 suspended therefrom. It is appreciated that in this configuration, multiple structures may be located along the track 30, including a number of support structures 20 deemed necessary to support the track 30 and carrier vehicles 50 traveling along the track 30. The support structure 20 may also include a cable support system 24 supporting the vertical beams overhead.

The support structure 20 may also be configured to stretch over water surfaces, similar to a bridge. The support structure 20 may further be integrated with surrounding structures, such as buildings, mountains, alternate cable supports, or various others, all which allow for the adequate support of the track 30.

C. Track

The track 30 is suspended from the support structure 20 in an above ground or water location, so that the carrier vehicle 50, which is suspended from the track 30, may also ride above the ground. In the preferred embodiment, the track 30 is comprised of a plurality of lower support cables 34 and preferably two elongated cables 34 arranged parallel with a vertical plane for receiving the wheels 51 of the carrier vehicle 50. The lower cables 34 of the track 30 are connected with supports 36 which connect to an upper support cable 35 in a tri-symmetrical manner. The supports 36 are thus preferably arranged in a tri-symmetrical; however other arrangements may be appreciated.

The track 30 preferably includes a primary lane 31 that travels along a well-traveled pathway similar to an interstate or pathway. The track 30 also includes a plurality of bypass lanes 32, 32', functioning as "exits", that are directed off the primary lane 31 to reach a loading/unloading station 40, 40'. It is appreciated that the bypass lanes 32, 32' described herein may refer to the first bypass lane, the second bypass lane, or multiple other bypass lanes. The track 30 thus has the ability to adjust or switch lanes, wherein the carrier vehicle 50 traveling along the primary lane 31 may switch onto the bypass lane 32, 32' to allow a user to enter or exit the carrier vehicle 50 at a loading/unloading station 40, 40'. The switching mechanism to change the routed track 30 from a primary lane 31 to a bypass lane 32, 32' is preferably similar to that used on a railroad track 30. The primary lane 31 and the bypass lane 32, 32' preferably each include their own respective series of cables 34, 35.

It is appreciated that multiple tracks 30 may be positioned alongside each other or intersect each other as necessitated to allow passengers to efficiently travel from a starting point to a destination. The primary lanes 31 of the multiple tracks 30 may thus connect with each other to allow a carrier vehicle 50 to transfer from a first primary lane to a second primary lane, or a primary lane to a bypass lane and back to the primary lane, along with various other configurations of routes. Other intermediate lanes may also be included along the track 30 to provide additional routing options for the passengers traveling within the carrier vehicles 50. It is appreciated that the tracks 30 may span long or short distances as desired and may travel through cities, buildings, across water, or across a country side, among other types of terrain.

The track 30 also generally includes an electrical cable 38 for distributing electrical energy to the multiple carrier vehicles 50 travelling along the track 30 for powering the wheels 51, allowing communication between the carrier vehicles 50, and controlling the speed, etc. of the carrier vehicles 50.

D. Loading/Unloading Station

The present invention includes a plurality of loading and unloading stations 40, 40' positioned along the track 30 for passengers to access and exit the carrier vehicles 50. The loading and unloading stations 40, 40' may be integral, wherein passengers enter the carrier vehicle 50 and exit the carrier vehicle 50 at the same stations 40, 40'. The unloading and loading stations 40, 40' may also be separate, wherein separate unloading stations 40' exist and separate loading stations 40 exist. It is appreciated that the terms "unloading station", "loading station", or "loading/unloading station" described herein refers to both integral loading and unloading stations 40, 40' and separate loading and unloading stations 40, 40'.

The stations 40, 40' are located at a plurality of stops or points of entrance that a passenger may want to exit the carrier vehicle 50 or enter upon the carrier vehicle 50. The stations 40, 40' may also be located at intersecting points of the tracks 30, wherein an individual may want to exit a first carrier vehicle 50 along a first track 30 at the station 40, 40' and then enter onto a second carrier vehicle 50 along a second track 30 at the same or a nearby station 40, 40'. It is appreciated that the stations 40, 40' are preferably located along the bypass lanes 32, 32' so as not to slow traffic along the primary lanes 31 of the track 30.

E. Carrier Vehicle

The present invention preferably includes a plurality of carrier vehicles 50 to travel along the track 30. It is appreciated that the carrier vehicles 50 may travel in-line with other carrier vehicles 50, be connected to other carrier vehicles 50, travel side-by-side with other carrier vehicles 50 or multiple other arrangements similar to highway systems and automobiles. The carrier vehicles 50 are also preferably generally separated by a predetermined distance (e.g. 100 feet, etc.) to prevent overloading of the support structures 20 and to prevent carrier vehicles 50 from engaging one another. The carrier vehicles 50 are further preferably automatically controlled to travel from location to location thus reducing the amount of staff or hired operators needed to effectively utilize the carrier vehicles 50.

The carrier vehicle 50 generally includes an electrical contact 58 to engage the elongated electrical cable 38 of the track 30 contact to provide electric power to the plurality of wheels 51 which travel along the track 30 and other electrical components of the carrier vehicle 50. The cable 38 runs parallel with the track 30. Electrically powered carrier vehicles 50 would allow the vehicles 50 to cars to silently and cleanly travel within malls and office buildings for optimum convenience to the travelling public. Having the carrier vehicles 50 electrically powered from a single supply source (or multiple supply sources) connected to the track 30 also allows for the control and synchronization of the multiple carrier vehicles 50. It is appreciated that the carrier vehicles 50 may also include motors or other power supplies.

The wheels 51 generally extend from a wheel 51 support 35 extending from the top side of the cab 55 of the carrier vehicle 50. Each of the wheels 51 are preferably angled inwards at similar orientations so that a groove 52 extending around the perimeter of the wheel 51 can receive the lower support cables 34 of the track 30 at least partially within to provide stability to the carrier vehicle 50 traveling along the track 30. The wheels 51 thus are located above the support cables 34 of the track 30 and the cab 55 of the carrier vehicle 50 is located below the support cables 34 of the track 30. It is appreciated that other connection mechanisms or arrangements may be used to secure the carrier vehicle 50 to the track 30.

The carrier vehicles 50 are able to travel at various different speeds (e.g. 50 mph, etc.). The speeds may be present at the installation of the carrier vehicles 50 or may be adjusted via the passengers riding within the carrier vehicles 50. The carrier vehicles 50 may also include a weight sensor to limit the number of passengers within the carrier vehicle 50 by not operating when a weight limit or passenger number is exceeded. An example weight limit would be 8000 pounds along with a 20 passenger limit per carrier vehicle 50. The carrier vehicles 50 are also preferably able to communicate with each other so that a carrier vehicle 50 knows if another carrier vehicle 50 is stopping at a requesting stop, slowing down, traveling at a different speed, crossing tracks 30, or various other actions.

The cab 55 of the carrier vehicle 50 may be comprised of various shapes and sizes. In the preferred embodiment, the cab 55 is able to accommodate and safely hold a plurality of passengers, such as a dozen or more. The cab 55 of the carrier vehicle 50 preferably includes a plurality of seats to accommodate the passengers with standing room also available as an option. The cabs 55 also preferably include a plurality of windows 56 surrounding the cab 55 so that passengers are allowed to view outside while traveling within the cab 55. The cab 55 may include various other amenities to provide for comfortable travel within the carrier vehicle 50.

F. First Control Module

The present invention preferably includes a first control module 60 and a second control module 70. The first control module 60 is located outside of the carrier vehicle 50 for signaling the carrier vehicle 50 (similar to the functionality of a call button) to stop along the track 30 at a loading station 40 along a bypass lane 32. The first control module 60 is preferably positioned at a loading/unloading station 40, 40'. In alternate embodiments, the first control module 60 may be positioned away from the loading/unloading station 40, 40' so that a user signals a carrier vehicle 50 to stop at the loading/unloading station 40, 40' at a particular time or date. The carrier vehicle 50 thus communicates with the first control module 60 to stop at the requested location.

The first control module 60 may include a plurality of buttons 61, wherein the buttons may be as simple as signaling the next carrier vehicle 50, or may be as complex as signaling a specific carrier vehicle 50 traveling a certain direction at a specific speed and so on. It is appreciated that the first control module 60 may be used to stop any general carrier vehicle 50 traveling along the desired route or a specific carrier vehicle 50 traveling along the desired route.

G. Second Control Module

The second control module 70 is located inside the carrier vehicle 50 for signaling the carrier vehicle 50 to stop along the track 30 at a loading/unloading station 40, 40' along the bypass lanes 32, 32'. The second control module 70 preferably operates similar to an elevator control panel, wherein when the passenger enters the cab 55 of the carrier vehicle 50, they simply push the button that accords with their desired destination. The carrier vehicle 50 thus communicates with the second control panel to stop at the requested destination.

The second control module 70 also preferably includes a plurality of buttons 71 or controls that may be engaged by the passenger. Each of the buttons represents a different stop along the track 30. To reach each stop, it is appreciated that the carrier vehicle 50 may need to switch lanes or tracks 30 altogether. The stops are generally at loading/unloading stations 40, 40' along the bypass lanes 32, 32' of the track 30.

H. Operation of Preferred Embodiment

In use, a passenger would operate the first control module 60 to signal a carrier vehicle 50 traveling along the respective route that the passenger desires to travel upon or is routed next to the loading/unloading station 40, 40' including the respective first control module 60. When the next carrier vehicle 50 nears the station 40, the carrier vehicle 50 exits onto the bypass lane 32 to allow the passengers to enter within the cab 55 of the carrier vehicle 50. It is appreciated that if the carrier vehicle 50 is exceeding the predetermined weight limit or near the predetermined weight limit (e.g. 75% of the weight limit reached), the carrier vehicle 50 will not stop at the station 40 if another carrier vehicle is coming within a predetermined time period (e.g. 15 minutes).

Once the passenger enters the cab 55 of the carrier vehicle 50, the passenger operates the second control module 70 to select a destination unloading station 40'. The carrier vehicle 50 will then proceed to the selected unloading station 40' and enter the bypass lane 32' leading to the unloading station 40' in which the passenger may exit the carrier vehicle 50. It is appreciated that the carrier vehicle 50 may stop at multiple other loading/unloading stations 40, 40' along the way to the selected loading/unloading station 40, 40' to unload or load other passengers. The present invention thus allows for a mass transportation system that is capable of carrying multiple passengers to various destinations (short and long distances) without the use of a separate operator or driver, wherein the carrier vehicles 50 simply run along the electric track 30 and are operable by the passengers via the first control module 60 and the second control module 70.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A transportation system, comprising:

a support structure;

a horizontal track connected to said support structure, wherein said track is positioned above ground level;

wherein said track includes a primary lane, a first bypass lane, and a second bypass lane, wherein said first bypass lane and said second bypass lane are connected to said primary lane;

a loading station accessible from said first bypass lane;

an unloading station accessible from said second bypass lane;

wherein said first bypass lane travels off said primary lane prior to said loading station and wherein said first bypass lane merges with said primary lane after said loading station;

wherein said second bypass lane travels off said primary lane prior to said unloading station and wherein said second bypass lane merges with said primary lane after said unloading station;

a carrier vehicle connected to said horizontal track, wherein said carrier vehicle is operable along said primary lane, said first bypass lane, and said second bypass lane of said track;

a first control module located outside said carrier vehicle at said loading station for signaling said carrier vehicle to stop along said first bypass lane at said loading station; and a second control module located inside said carrier vehicle for signaling said carrier vehicle to stop along said second bypass lane at said unloading station;

wherein said horizontal track is comprised of a plurality of cables arranged in a tri-symmetrical orientation; said carrier vehicle includes a plurality of wheels to travel along said series of cables and said plurality of wheels angle inwardly.

2. The transportation system of claim 1, wherein said horizontal track comprises a plurality of horizontal tracks, wherein said plurality of horizontal tracks are interconnected.

3. The transportation system of claim 1, wherein said horizontal track adjusts to direct said carrier vehicle from said primary lane to said first bypass lane and said second bypass lane.

4. The transportation system of claim 1, wherein said first control module is comprised of a call button operable by a passenger of said carrier vehicle.

5. The transportation system of claim 1, wherein said second control module is comprised of a series of buttons operable by a passenger of said carrier vehicle.

6. The transportation system of claim 1, wherein said horizontal track includes an electrical cable to distribute electrical energy to said carrier vehicle to power said carrier vehicle.

7. The transportation system of claim 1, wherein said plurality of wheels suspend said carrier vehicle from said plurality of cables.

8. The transportation system of claim 1, wherein said carrier vehicle includes a weight sensor to limit a number of passengers within said carrier vehicle.

9. The transportation system of claim 1, wherein said support structure includes a pair of spaced apart vertical columns and a horizontal structure connecting said vertical columns.

10. The transportation system of claim 9, wherein said track is suspended from said horizontal structure.

11. The transportation system of claim 10, wherein said carrier vehicle is suspended from said track.

12. The transportation system of claim 1, wherein said carrier vehicle maintains a predetermined distance between said carrier vehicle and a second carrier vehicle, wherein said predetermined distance is comprised of a distance that prevents overloading of said support structure.

13. A mass transportation system, comprising:

a support structure;

a horizontal track suspended from said support structure, wherein said track is positioned above ground level;

wherein said track includes a primary lane, a first bypass lane, and a second bypass lane, wherein said first bypass lane and said second bypass lane are connected to said primary lane;

a loading station accessible from said first bypass lane;

an unloading station accessible from said second bypass lane;

wherein said first bypass lane travels off said primary lane prior to said loading station and wherein said first bypass lane merges with said primary lane after said loading station;

wherein said second bypass lane travels off said primary lane prior to said unloading station and wherein said second bypass lane merges with said primary lane after said unloading station;

a carrier vehicle suspended from said horizontal track, wherein said carrier vehicle is operable along said primary lane, said first bypass lane, and said second bypass lane of said track;

a first control module located outside said carrier vehicle at said loading station for signaling said carrier vehicle to stop along said first bypass lane at said loading station; and a second control module located inside said carrier vehicle for signaling said carrier vehicle to stop along said second bypass lane at said unloading station;

wherein said horizontal track is comprised of a plurality of cables arranged in a tri-symmetrical orientation; said carrier vehicle includes a plurality of wheels to travel along said series of cables and said plurality of wheels angle inwardly.

14. The transportation system of claim 13, wherein said horizontal track comprises a plurality of horizontal tracks, wherein said plurality of horizontal tracks are interconnected.

15. The transportation system of claim 13, wherein said horizontal track adjusts to direct said carrier vehicle from said primary lane to said first bypass lane and said second bypass lane.

16. The transportation system of claim 13, wherein said carrier vehicle maintains a predetermined distance between said carrier vehicle and a second carrier vehicle, wherein said predetermined distance is comprised of a distance that prevents overloading of said support structure.

17. A mass transportation system, comprising:

a support structure;

a horizontal track connected to said support structure, wherein said track is positioned above ground level;

wherein said track includes a primary lane, a first bypass lane, and a second bypass lane, wherein said first bypass lane and said second bypass lane are connected to said primary lane;

a loading station accessible from said first bypass lane;

an unloading station accessible from said second bypass lane;

wherein said first bypass lane travels off said primary lane prior to said loading station and wherein said first bypass lane merges with said primary lane after said loading station;

wherein said second bypass lane travels off said primary lane prior to said unloading station and wherein said second bypass lane merges with said primary lane after said unloading station;

a carrier vehicle connected to said horizontal track, wherein said carrier vehicle is operable along said primary lane, said first bypass lane, and said second bypass lane of said track;

a first control module located outside said carrier vehicle at said loading station for signaling said carrier vehicle to stop along said first bypass lane at said loading station; and a second control module located inside said carrier vehicle for signaling said carrier vehicle to stop along said second bypass lane at said unloading station;

wherein said horizontal track comprises a plurality of horizontal tracks, wherein said plurality of horizontal tracks are interconnected;

wherein said horizontal track adjusts to direct said carrier vehicle from said primary lane to said first bypass lane and said second bypass lane;

wherein said first control module is comprised of a call button operable by a passenger of said carrier vehicle;

wherein said second control module is comprised of a series of buttons operable by a passenger of said carrier vehicle;

wherein said horizontal track includes an electrical cable to distribute electrical energy to said carrier vehicle to power said carrier vehicle;

wherein said horizontal track is comprised of a plurality of cables arranged in a tri-symmetrical orientation;

wherein said carrier vehicle includes a plurality of wheels to travel along said series of cables;

wherein said plurality of wheels angle inwardly;

wherein said plurality of wheels suspend said carrier vehicle from said plurality of cables;

wherein said carrier vehicle includes a weight sensor to limit a number of passengers within said carrier vehicle;

wherein said carrier vehicle maintains a predetermined distance between said carrier vehicle and a second carrier vehicle, wherein said predetermined distance is comprised of a distance that prevents overloading of said support structure;

wherein said support structure includes a pair of spaced apart vertical columns and a horizontal structure connecting said vertical columns;

wherein said track is suspended from said horizontal structure;

wherein said carrier vehicle is suspended from said track.

* * * * *